US005173030A

United States Patent [19]

Heimhard et al.

[11] Patent Number: 5,173,030

[45] Date of Patent: Dec. 22, 1992

[54] JET PIPE

[75] Inventors: Hans-Jürgen Heimhard, Mülheim-Saarn; Manfred Bräuer, Bensheim, both of Fed. Rep. of Germany

[73] Assignee: Klockner Oecotec GmbH, Duisburg, Fed. Rep. of Germany

[21] Appl. No.: 746,188

[22] Filed: Aug. 15, 1991

Related U.S. Application Data

[63] Continuation of Ser. No. 617,461, Nov. 26, 1990, which is a continuation of Ser. No. 426,639, Oct. 26, 1989.

[30] Foreign Application Priority Data

Oct. 27, 1988 [DE] Fed. Rep. of Germany ..... 3836661

[51] Int. Cl.[5] ..... F04F 5/22

[52] U.S. Cl. ..... 417/163; 417/179

[58] Field of Search ..... 417/151, 163, 170, 197, 417/198, 179

[56] References Cited

U.S. PATENT DOCUMENTS

| | | | |
|---|---|---|---|
| 685,117 | 10/1901 | Earle | 417/170 |
| 2,100,185 | 11/1937 | Engstrand | 417/197 |
| 3,838,946 | 10/1974 | Schall | 417/395 |
| 4,400,138 | 8/1983 | Baer | 417/197 |
| 4,487,553 | 12/1984 | Nagata | 417/163 |
| 4,718,835 | 1/1988 | Maruyama | 417/179 |
| 4,776,731 | 10/1988 | Briggs et al. | 417/179 |

*Primary Examiner*—Richard A. Bertsch
*Assistant Examiner*—Michael I. Kocharov
*Attorney, Agent, or Firm*—Lowe, Price, LeBlanc & Becker

[57] ABSTRACT

A jet pipe comprises a housing having a suction inlet for the medium to be taken in and an outlet, a conical tubular portion following the suction inlet towards the outlet and a section adjacent to the suction inlet provided with discharge openings arranged peripherally around the tubular interior for a discharge of a highly pressurized medium. When such jet pipes are used for processing contaminated soil, the wear of the individual parts of the jet pipe causes high expenses and non-productive time. In order to reduce wear and non-productive time, the section comprising the outlet openings is formed as a replaceable ring.

13 Claims, 3 Drawing Sheets

JET PIPE

This application is a continuation of application Ser. No. 07/617,461 filed Nov. 26, 1990.

Which application is a continuation of application Ser. No. 07/426,639 filed Oct. 26, 1989.

FIELD OF THE INVENTION

This invention relates to a jet pipe and in particular to a jet pipe for processing contaminated soil.

BACKGROUND OF THE PRIOR ART

Such a jet pipe is disclosed in the German Patent Specification 21 50 711. In this known jet pipe the section adjacent to the suction inlet and the conical tubular portion are interconnected by means of screws. In the operation of such a jet pipe highly pressurized water is supplied to the supply piece and enters the tubular interior through outlet openings in direction of a conical envelope. By means of this effect a sand-water or soil-water mixture is aspirated at the inlet and passed through the conical water envelope. A swirling action occurs which leads to high wear of the conical tubular portion and of the region comprising the outlet openings. A replacement of worn parts leads to considerable non-productive time, in particular where two such jet pipes are connected in series.

German Patent DD 153 905 discloses a multi-stage jet pipe having a cylindrical or divergent section following a diffusor. The individual stages are interconnected by means of screws. U.S. Pat. No. 2,396,290 discloses a multi-stage jet pump having divergent or cylindrical sections following the diffusor. Individual sections of the apparatus are screwed together.

OBJECTS OF THE INVENTION

It is an object of the invention to provide an improved jet pipe. It is a further object to design a jet pipe such that the parts subjected to wear can be easily replaced. It is a still further object of the invention to design a jet pipe such that additionally wear is reduced.

SUMMARY OF THE INVENTION

In order to achieve the above-mentioned objects the invention provides a jet pipe comprising a housing having a suction inlet for the medium to be taken in and an outlet, a conical tubular portion following the suction inlet towards the outlet and a section adjacent to the suction inlet, the section being formed as a replaceable ring and having outlet openings arranged peripherally around the tubular interior for discharge of a highly pressurized medium supplied thereto through a channel from a supply piece.

BRIEF DESCRIPTION OF THE DRAWINGS

Further advantages, features and objects of the invention will be understood from the following description of a preferred embodiment with reference to the drawings, wherein.

DESCRIPTION OF THE PREFERRED EMBODIMENT

Figure 1:
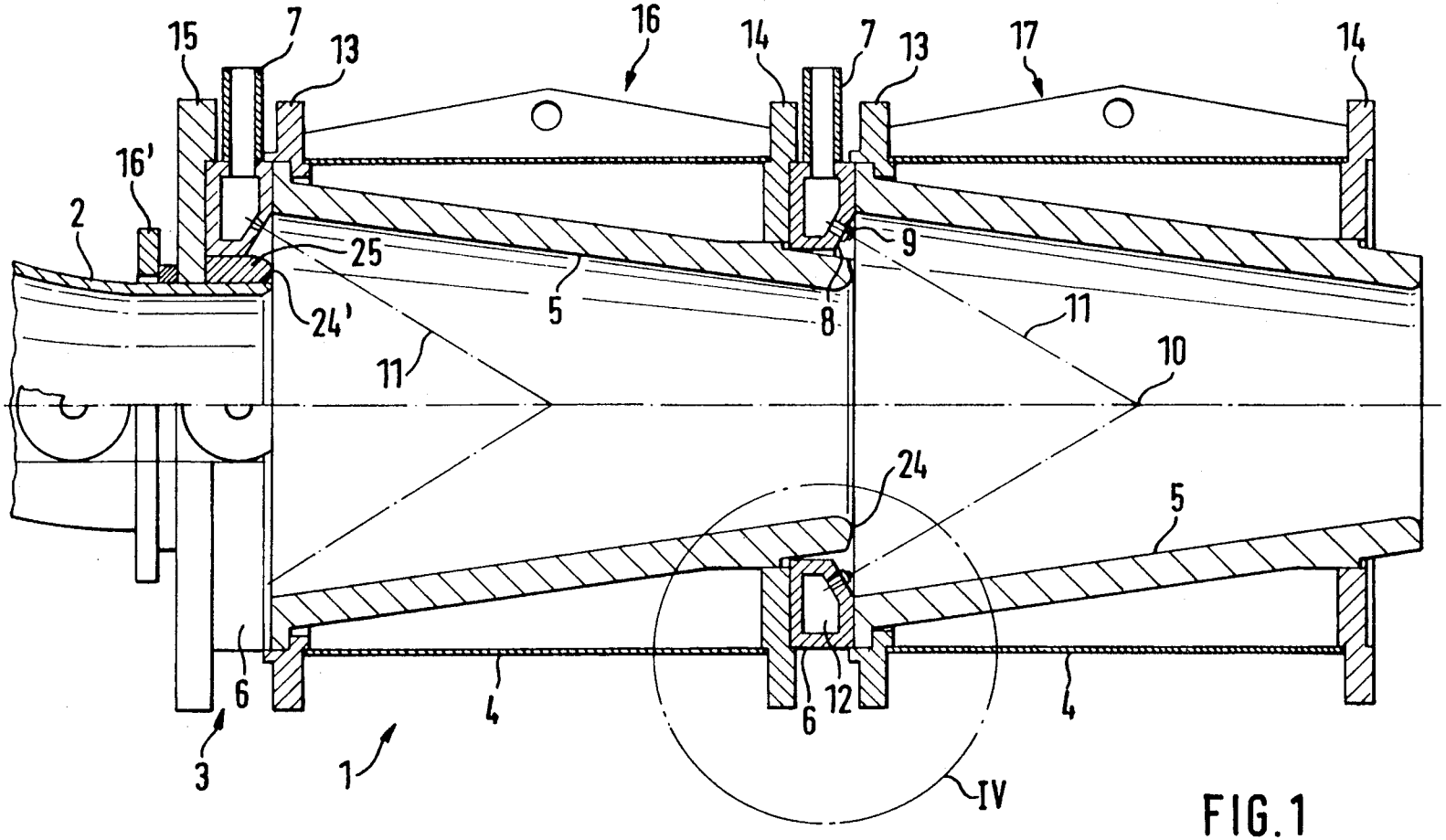
FIG. 1 is a sectional view of a jet pipe with two jet pipe sections arranged in series.
Figure 2:
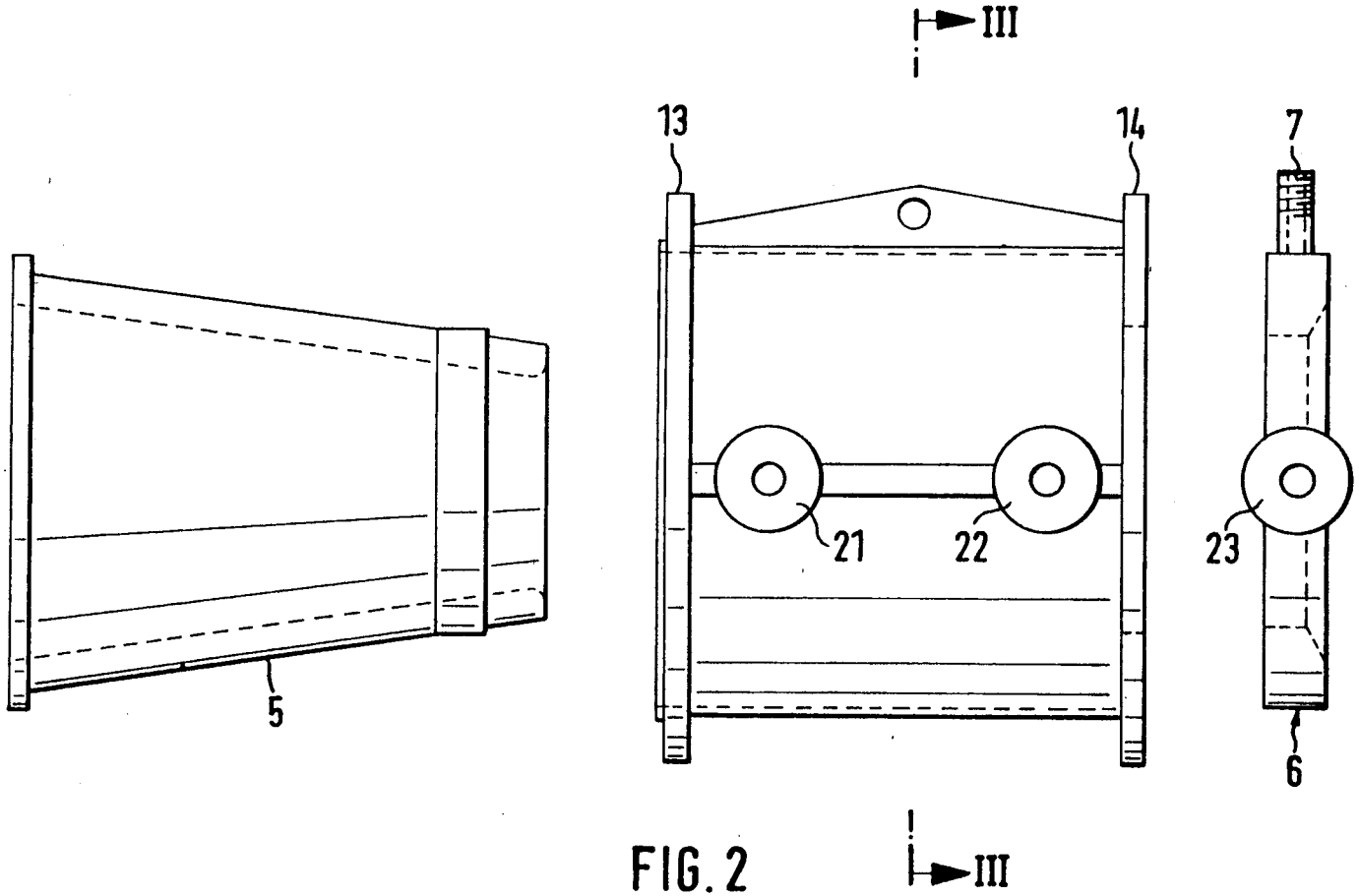
FIG. 2 is an exploded lateral view of a jet pipe with the individual parts.
Figure 4:
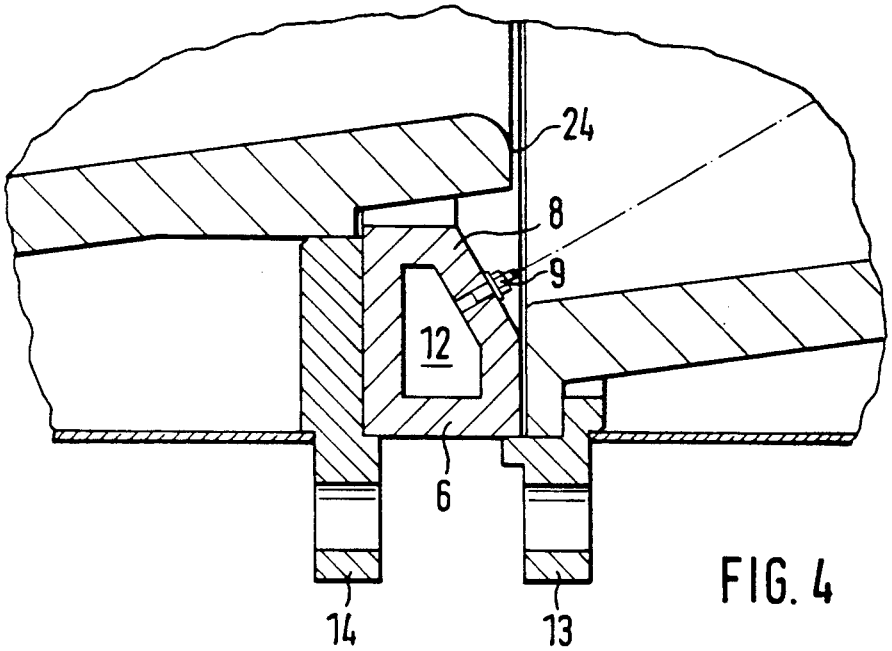
FIG. 4 is a detail of FIG. 1.

The jet pipe 1 comprises a section 3 which is connected with a feed line 2 for supply of a medium to be taken in, a jet pipe housing 4 and a conical tubular portion 5 extending within the interior of the housing 4.

The section 3 is formed as a ring 6 having a supply piece 7 which is adapted to be connected with a conduit for supply of a pressurized fluid medium, in particular water. An outside conical surface 8 of a distal forward end of conical tubular portion 5 extends into the interior of the jet pipe or tubular portion and is inclined with respect to the axis of the pipe. The surface 8 is provided with peripherally offset discharge nozzles 9 having their axes aligned such that water is discharged therefrom towards a common axial point 10 within the interior of the pipe and forms a conical water envelope 11. The discharge nozzles 9 are connected to the supply piece through a channel 12 extending in peripheral direction within the ring 6. The jet pipe housing 4 comprises a first flange 13 at the inlet side and a second flange 14 at the outlet side. The interiors of both flanges are formed such that the conical tubular portion 5 can be pushed into the jet pipe housing 4 and is coaxially fixed by the two connecting pieces. The ring 6 is coaxially flanged at the inlet side by means of screws and an outer second annular flange 15. A further flange 16' connects the feed line with the section 3.

In the embodiment shown in FIG. 1 two jet pipe portions 16 and 17 are arranged in series, and the ring 6 associated to the jet pipe section 17 is fixed in place by the exit flange 14 of the preceding jet pipe section 16.

The conical tubular portion 5 is designed such that the outlet end 24 thereof extends into the section 3 of the succeeding jet pipe section to such an extent that the discharge nozzles 9 are covered as seen in a radial projection. This prevents abrasion and destruction of the nozzles by means of the material passed through the pipe. A corresponding annular insert 25 corresponding in shape to the end 24 of the conical tubular portion is inserted at the inlet side of the first jet pipe section. The annular insert 25 forms a ring and comprises a free lip 24' and is provided between feed line 2 and ring 6. The lip 24' prevents nozzles 9 from being damaged in the same way as free end 24.

According to another solution the end of the feed line 2 is extended into the interior to such an extent that the material taken in does not swirl directly along the nozzles.

Figure 3:
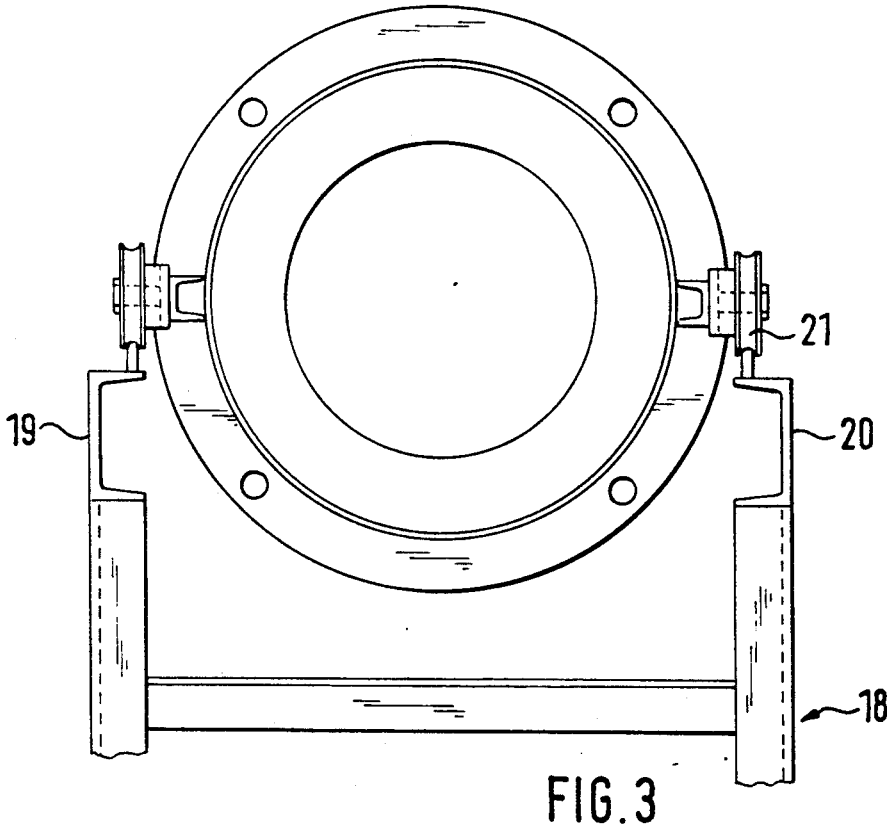
FIG. 3 is a view of the jet pipe shown in FIG. 2 from the inlet side.

As may be seen in particular from FIG. 3, the jet pipe comprises a support frame 18 having two lateral rails. The jet pipe housing and the ring 6 have pairs of rollers 21, 22; 23 provided at both sides thereof. With to these roller pairs, a conical tubular portion 5 can be replaced in a simple manner by moving away the ring 6 after unscrewing the flange screws and removing and replacing the tubular portion 5. In the same simple manner, eventual maintenance work at the discharge nozzles 9 may be performed.

In the above described embodiment water was supplied through the supply pieces 7. Alternatively, steam may be supplied through one of the supply pieces, if desired, to obtain efficient flow of certain components.

While the invention has been described in its preferred form, it is not limited to the precise nature structures shown, as various modifications may be made without departing from the scope of the appended claims.

What is claimed is:

1. A jet pipe flow system, comprising:

a jet pipe housing having a first flange at a flow inlet end and a second flange at a flow outlet end;

a conical tubular insert formed to be inserted into said jet pipe housing, the conical tubular insert having a large diameter end locatable adjacent said inlet flow end of the jet pipe housing and tapering toward a small diameter end locatable adjacent said flow outlet end of the jet pipe housing;

a ring having an inlet and a plurality of discharge openings that are arranged peripherally at an annular surface, said ring being formed to fit to said conical tubular insert with said discharge openings disposed to enable a flow of a flow-generating medium within the largest diameter of said conical tubular insert, said ring being fixed between the first flange of said jet pipe housing and an inlet element connected to the inlet end of the jet pipe housing.

2. The jet pipe flow system of claim 1, wherein:

said ring comprises a plurality of nozzles arranged at said discharge openings to generate a first flow of a pressurized flow-generating medium therethrough, said first flow being provided from a supply piece via a channel connecting said nozzles with said supply piece.

3. The jet pipe flow system of claim 1, wherein:

a terminal portion of said tubular insert forms a shield covering said discharge openings to prevent erosion of said discharge openings while permitting flow therethrough of said flow-generating medium toward the interior of the pipe.

4. The jet pipe flow system of claim 1, wherein:

said small diameter end of the tubular insert is formed so as to extend through said ring when said ring is disposed between an adjacent jet pipe housing connected thereto to protect said ring from flow of abrasive material through said pipe flow system.

5. The jet pipe flow system of claim 1, wherein:

at least one of said jet pipe housing and said ring comprises a pair of wheels arranged laterally for supporting the same and facilitating disassembling of the jet pipe flow system.

6. The system of claim 1, further comprising a ring-like annular insert having a lip at one end, located inside said ring such that said lip extends downstream of said discharge opening in a direction of discharge therefrom, a surface of said lip abutting said annular flange.

7. The jet pipe flow system of claim 1, wherein:

said tubular insert and said ring are mounted together in a replaceable manner.

8. The jet pipe flow system of claim 7, wherein:

one of said jet pipe housing and said ring comprises a pair of wheels arranged laterally for supporting the same and facilitating disassembling of the flow system.

9. The jet pipe flow system of claim 8, wherein:

a guiding frame is provided for guiding and supporting the pair of wheels.

10. A jet pipe flow system, comprising:

a jet section with a housing having a suction inlet and an outlet for a flow therethrough of a flowable medium, with a replaceable conical tubular portion following the suction inlet and tapering towards said outlet, said housing being provided with first and second flanges at respective first and second ends;

a section adjacent to said suction inlet, said section being formed as a replaceable ring having a plurality of discharge openings arranged peripherally therein within the largest diameter and outside the narrowest diameter of the conical portion for discharge of a first flow of a pressurized flow-generating medium, supplied thereto thorough a channel from a supply piece, in a predetermined direction angled toward an axis of the housing and toward said outlet; and an annular flange connected to the housing, disposed such that said ring is replaceably mounted between the annular flange and the first flange of the housing.

11. The system of claim 10, further comprising a ring-like annular insert having a lip at one end, located inside said replaceable ring such that said lip extends downstream of said discharge opening in a direction of discharge therefrom, a surface of said lip abutting said annular flange.

12. A jet pipe flow system, comprising:

a first jet pipe housing adapted to be connected in series with a second jet pipe housing, the first and second jet pipe housings each having a first flange at a flow inlet end thereof and a second flange at a flow outlet end thereof;

a conical tubular insert for each jet pipe housing, the insert formed to be inserted into its respective jet pipe housing, the conical tubular insert having a large diameter end locatable adjacent said flow inlet end of its respective jet pipe housing and tapering toward a small diameter end locatable adjacent said flow outlet end of the same jet pipe housing; and a ring for each jet pipe housing, each ring having an inlet and a plurality of discharge openings that are arranged peripherally at an annular surface of the ring and are angled to discharge a flow toward an axis of its respective housing in the direction of the outlet of the same housing, said ring being selectively fixed between the first flange of said first jet pipe housing and an inlet element connected to the inlet end of the first jet pipe housing or between the corresponding first flange of an adjacent second jet pipe housing and the second flange at the outlet end of said first jet pipe housing, said discharge openings being disposed on said each ring radially between the inner surface of a portion of a said conical tubular insert near the large diameter end and the outer surface of a portion of the insert near the small diameter end.

13. A jet pipe flow system, comprising:

a jet pipe housing having a first flange at a flow inlet end thereof and a second flange at a flow outlet end thereof;

a conical tubular insert formed to be inserted into said jet pipe housing, the conical tubular insert having a large diameter end locatable adjacent said inlet flow end of the jet pipe housing and tapering toward a small diameter end locatable adjacent said flow outlet end of the jet pipe housing;

a ring having an inlet and a plurality of discharge openings that are arranged peripherally at an annular surface thereof, said ring being formed to fit to said conical tubular insert with said discharge openings disposed to enable a flow of a flow-generating medium within the largest diameter of said conical tubular insert, said ring being fixed between the second flange at the outlet end of said jet pipe housing and the corresponding first flange of an adjacent jet pipe housing.

* * * * *